US007121747B2

(12) United States Patent
Hayashi et al.

(10) Patent No.: US 7,121,747 B2
(45) Date of Patent: Oct. 17, 2006

(54) DRIVE CONTROLLING METHOD FOR CARRIAGE AND COMPUTER READABLE MEDIUM INCLUDING DRIVE CONTROLLING PROGRAM, ELECTRONIC APPARATUS, RECORDING APPARATUS, AND LIQUID EJECTING APPARATUS

(75) Inventors: Toru Hayashi, Nagano (JP); Takayuki Ishii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/236,731

(22) Filed: Sep. 28, 2005

(65) Prior Publication Data

US 2006/0147237 A1 Jul. 6, 2006

(30) Foreign Application Priority Data

Sep. 28, 2004 (JP) ..... P2004-281019

(51) Int. Cl.
*B41J 11/44* (2006.01)
*B41J 29/393* (2006.01)
*B41J 23/00* (2006.01)

(52) U.S. Cl. ..... 400/76; 347/19; 347/37

(58) Field of Classification Search ..... 400/76, 400/279, 319, 320, 322, 292; 347/19, 37, 347/4

See application file for complete search history.

(56) References Cited

U.S. PATENT DOCUMENTS 5,871,291 A * 2/1999 Kawazoe ..... 400/279
5,964,542 A * 10/1999 Ruhe et al. ..... 400/352
6,004,050 A * 12/1999 Rehman et al. ..... 400/319
6,244,765 B1 * 6/2001 Harriman et al. ..... 400/319
6,619,778 B1 * 9/2003 Igarashi ..... 347/19
6,695,426 B1 * 2/2004 Herwald et al. ..... 347/19
6,793,303 B1 * 9/2004 Ikeda ..... 347/4
6,805,426 B1 * 10/2004 Kokubo et al. ..... 347/19

FOREIGN PATENT DOCUMENTS

| | | |
|---|---|---|
| EP | 1 291 191 A1 | 3/2003 |
| EP | 1 323 538 A1 | 7/2003 |
| JP | 10035051 | 2/1998 |
| JP | 2002356033 | 12/2002 |

* cited by examiner

*Primary Examiner*—Daniel J. Colilla
*Assistant Examiner*—Wasseem H. Hamdan
(74) *Attorney, Agent, or Firm*—Sughrue Mion, PLLC

(57) ABSTRACT

A drive controlling method for a carriage which permits absorbing of a vibration caused by cogging, eccentricity of a motor pulley, or the like, without providing a vibration absorbing mechanism; and an electronic apparatus and a liquid ejecting apparatus provided with a carriage controlled by this controlling method. The drive controlling method includes: detecting a first period, a first phase, and a first amplitude of a vibration generated in the carriage; and controlling a velocity of the carriage on the basis of a signal having a second period and a second amplitude each of which is the same as the first period and the first amplitude, and having a second phase shifted by a predetermined value from the first phase.

13 Claims, 9 Drawing Sheets

DRIVE CONTROLLING METHOD FOR CARRIAGE AND COMPUTER READABLE MEDIUM INCLUDING DRIVE CONTROLLING PROGRAM, ELECTRONIC APPARATUS, RECORDING APPARATUS, AND LIQUID EJECTING APPARATUS

BACKGROUND OF THE INVENTION

1. Technical Field of the Invention

The present invention relates to: a drive controlling method for a carriage which can eliminate influences of cogging of a carriage drive motor for driving the carriage along a guide member and a periodic change of a carriage drive motor velocity caused by a motor pulley and the like for driving the carriage; a computer readable medium including a computer program for performing this controlling method; and an electronic apparatus provided with a carriage controlled by this controlling method.

2. Description of the Related Art

In some recording apparatuses in which a carriage performs reciprocating drive in a horizontal direction perpendicular to the direction of paper feed for printing paper so that printing is performed, ink drops are discharged from nozzles of a recording head mounted on the carriage, and thereby dropped on the surface of the printing paper so that printing is performed. The reciprocating drive in the horizontal direction of the carriage is performed by a carriage drive motor via a motor pulley. The carriage drive motor employed here is generally a DC motor. However, a brushless DC motor requires gaps referred to as slots between magnetic poles. Thus, the shaft of the DC motor does not revolve smoothly, and hence a vibration is generated, as is well-known. This vibration is called cogging in some cases, and generated periodically, as is well-known. Further, the motor pulley for the carriage has eccentricity depending on the machining accuracy of the motor pulley, and hence provides a part of the cause of a periodic velocity fluctuation in the carriage drive motor (See, Japanese Published Unexamined Patent Application No. 2002-356033).

The vibration of a relatively short period generated by cogging of the carriage drive motor and the like and the vibration of a relatively long period caused by eccentricity of the motor pulley and the like are unavoidable. These has caused vibrations in the carriage and hence nonuniformity in the recording pitch of the main scanning direction. Thus, in order to prevent the carriage vibration, countermeasures have been proposed such as providing a vibration absorbing mechanism in the carriage. However, this causes the problem of complexity in the apparatus.

SUMMARY OF THE INVENTION

The invention has been devised in view of the various problems. An object of at least one embodiment of the invention is to provide a drive controlling method for a carriage which permits absorbing of a vibration caused by cogging, eccentricity of a motor pulley, or the like, without providing a vibration absorbing mechanism; a computer readable medium including a computer program for performing this controlling method; and a recording apparatus and a liquid ejecting apparatus provided with a carriage controlled by this controlling method. The invention is as follows:

(1). A drive controlling method of a carriage for performing reciprocating motion along a guide member, comprising:

detecting a first period, a first phase, and a first amplitude of a vibration generated in the carriage; and controlling a velocity of the carriage on the basis of a signal having a second period and a second amplitude each of which is the same as the first period and the first amplitude, and having a second phase shifted by a predetermined value from the first phase.

This permits damping of a vibration caused by cogging, eccentricity of a motor pulley, or the like, without providing a complicated vibration absorbing mechanism.

(2). The drive controlling method according to (1), further comprising performing arithmetic analysis on the velocity of the carriage to detect the first period, the first amplitude, and the first phase.

This permits easy acquisition of a period, an amplitude, and a phase of a vibration caused by cogging, eccentricity of the motor pulley, or the like.

(3). The drive controlling method according to (1), further comprising extracting a vibration affecting precision from the vibration generated in the cartridge to damp the vibration affecting precision.

Thus, an unnecessary vibration can solely be selected from a vibration caused by cogging, eccentricity of a motor pulley, and the like, and then damped.

(4). The drive controlling method according to (1), wherein the predetermined value is a value for providing an opposite phase signal to a power source of the carriage.

Thus, when the predetermined value is changed, this method is applicable to any control block having an arbitrary controlling delay value. Here, the opposite phase signal is a generic name of various signals each having a phase shifted by a predetermined value from the phase of the vibration caused by cogging, eccentricity of the motor pulley, or the like, and is not limited to a signal shifted by 180° from the phase of the vibration. That is, the shift may be at any value.

(5). The drive controlling method according to (1), wherein the predetermined value is 180°±90°.

This permits setting up of an optimal predetermined value, and hence minimizes the vibration.

(6). A computer-readable medium including a set of instructions of controlling a carriage for performing reciprocating motion along a guide member, the set of instructions comprising:

detecting a first period, a first phase, and a first amplitude of a vibration generated in the carriage; and controlling a velocity of the carriage on the basis of a signal having a second period and a second amplitude each of which is the same as the first period and the first amplitude, and having a second phase shifted by a predetermined value from the first phase.

This permits damping of a vibration caused by cogging, eccentricity of a motor pulley, or the like, without providing a complicated vibration absorbing mechanism.

(7). The drive computer-readable medium according to (6), further comprising performing arithmetic analysis on the velocity of the carriage to detect the first period, the first amplitude, and the first phase.

This permits easy acquisition of a period, an amplitude, and a phase of a vibration caused by cogging, eccentricity of the motor pulley, or the like.

(8). The computer-readable medium according to (6), further comprising extracting a vibration affecting a precision from the vibration generated in the cartridge to damp the vibration affecting a precision.

Thus, an unnecessary vibration can solely be selected from a vibration caused by cogging, eccentricity of a motor pulley, and the like, and then damped.

(9). The computer-readable medium according to (6), wherein the predetermined value is a value for providing an opposite phase signal to a power source of the carriage.

Thus, when the predetermined value is changed, this method is applicable to any control block having an arbitrary controlling delay value. Here, the opposite phase signal is a generic name of various signals each having a phase shifted by a predetermined value from the phase of the vibration caused by cogging, eccentricity of the motor pulley, or the like, and is not limited to a signal shifted by 180° from the phase of the vibration. That is, the shift may be at any value.

(10). The computer-readable medium according to claim 6, wherein the predetermined value is 180°+90°.

This permits setting up of an optimal predetermined value, and hence minimizes a vibration.

(11). An electronic apparatus for at least one of reading and writing information, comprising a carriage controlled by a controlling method according to (1).

This realizes an electronic apparatus having each of the operations and effects (12). A recording apparatus for recording information on a recording medium, comprising a carriage controlled by a controlling method according to claim 1.

This realizes a recording apparatus having each of the operations and effects.

(13). A liquid ejecting apparatus for ejecting liquid toward a target medium, comprising a carriage controlled by a controlling method according to claim 1.

This realizes a liquid ejecting apparatus having each of the operations and effects.

DETAILED DESCRIPTION OF THE INVENTION

One embodiment of the invention is described below with reference to the drawings. Here, the embodiment described below does not place a limit on the invention defined in the claims. Further, the combination of all the features described in the embodiment is not necessarily indispensable in the solving means of the invention.

First, the configuration of an ink jet printer serving as a recording apparatus according to an embodiment of the invention is described below with reference to FIGS. 1 through 5.

Figure 1:
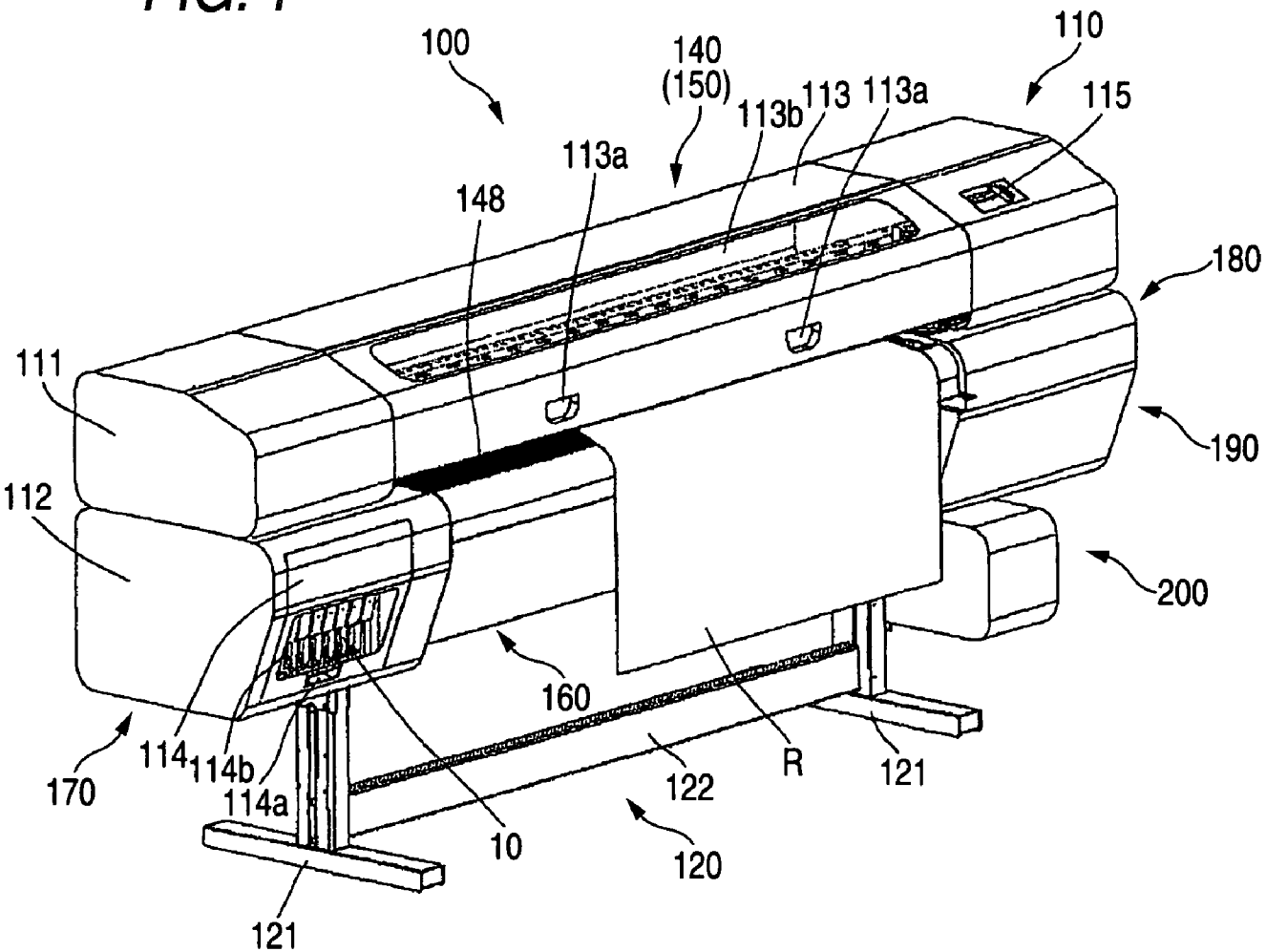
FIG. 1 is a first perspective view of an example of external appearance configuration of an ink jet printer serving as a recording apparatus according to an embodiment of the invention, viewed from the front side.
Figure 2:
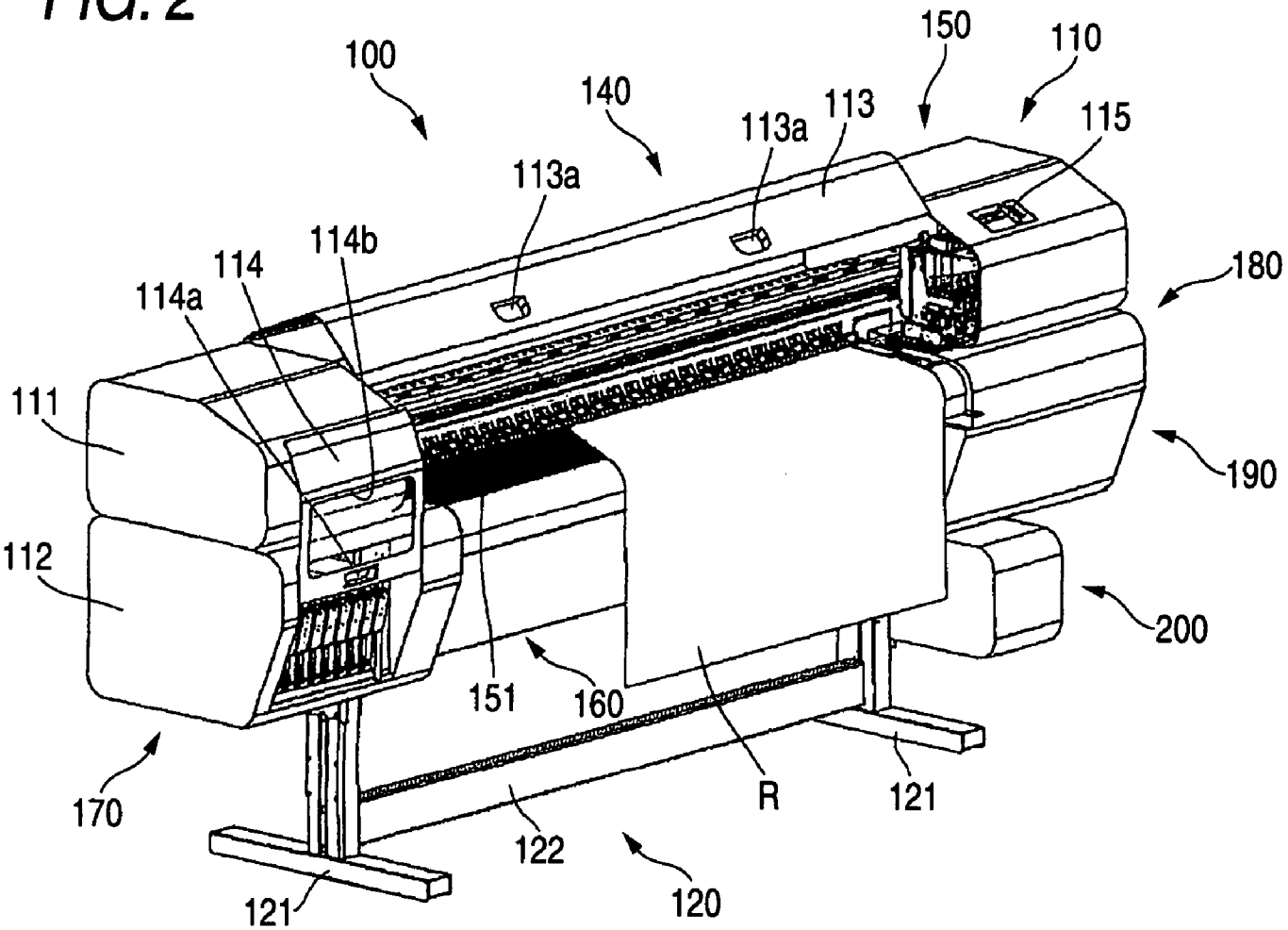
FIG. 2 is a second perspective view of an example of external appearance configuration of the printer of FIG. 1 viewed from the front side.
Figure 3:
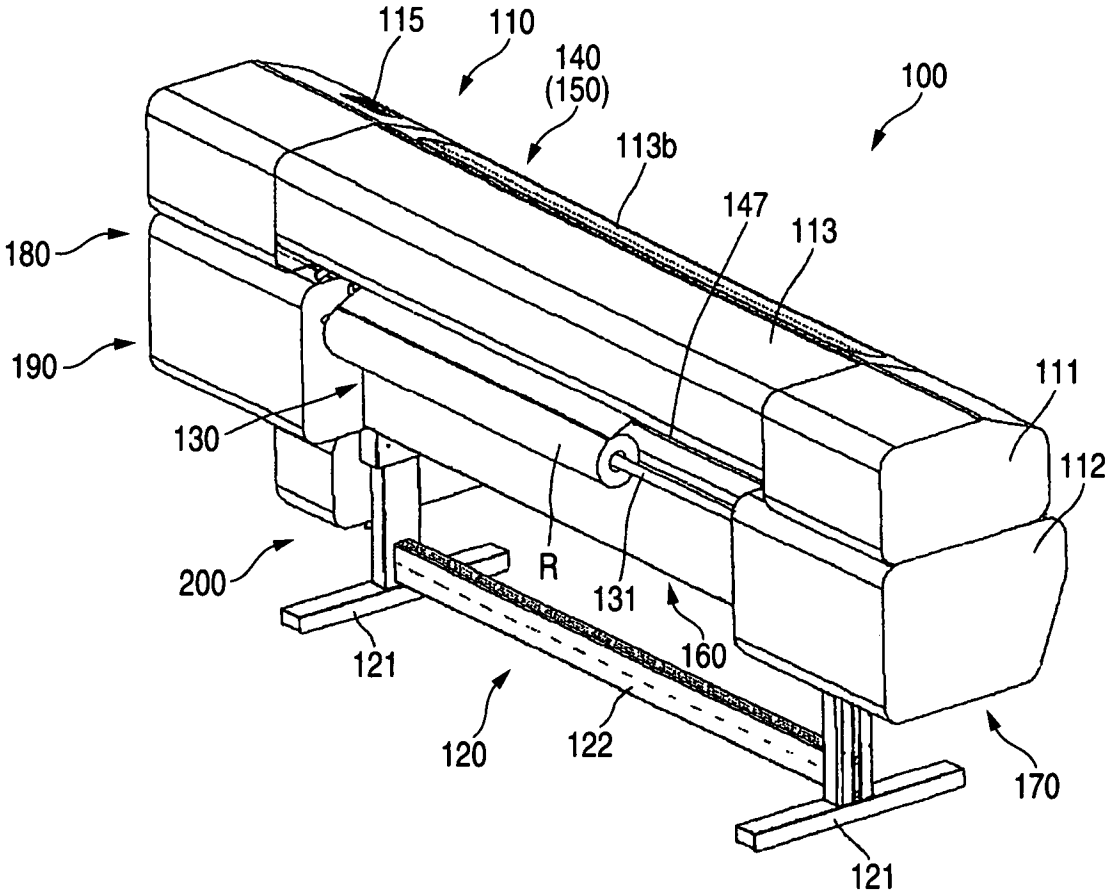
FIG. 3 is a perspective view of the printer of FIG. 1 viewed from the rear side.
Figure 4:
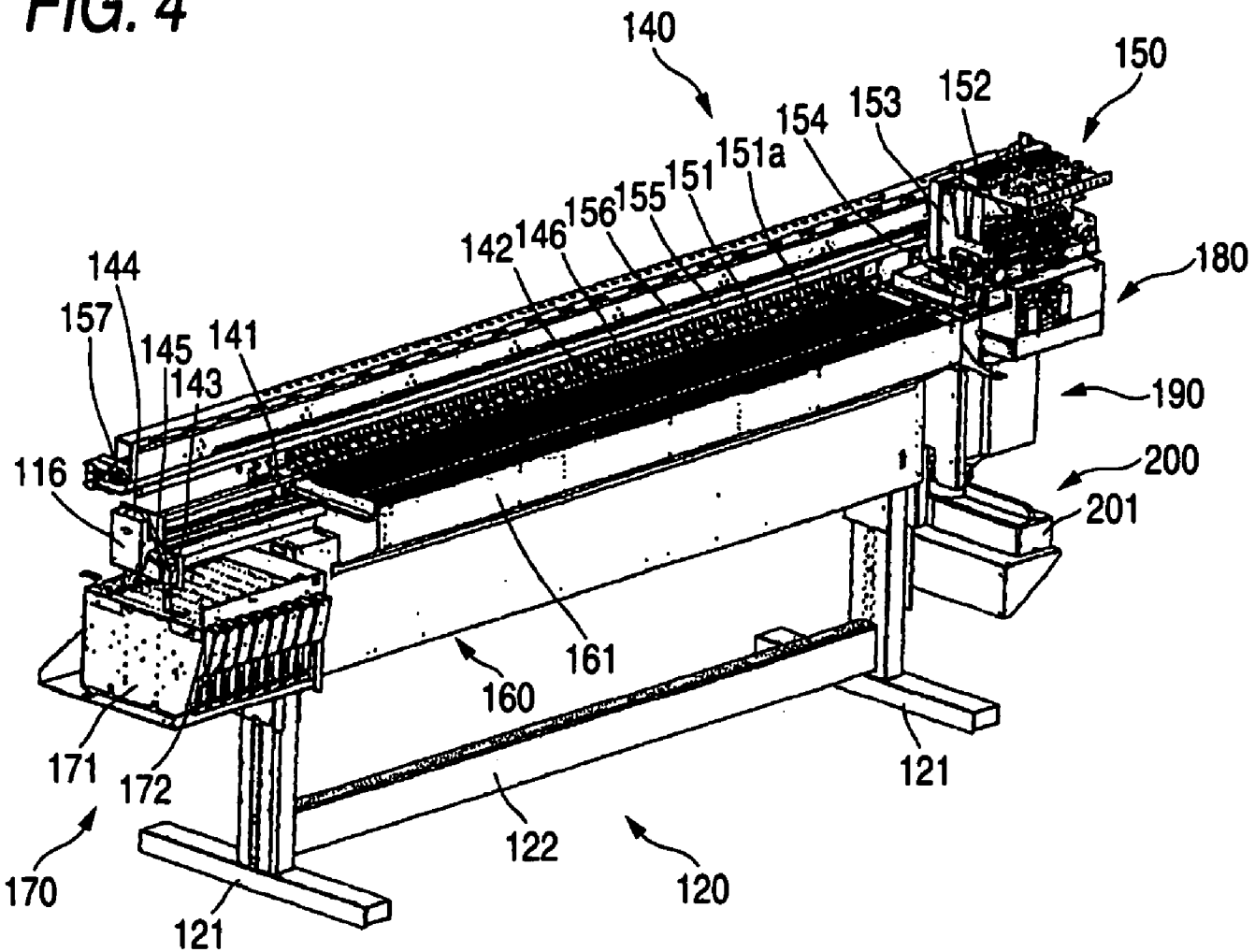
FIG. 4 is a perspective view showing the internal structure of the printer of FIG. 1.

FIGS. 1 and 2 are perspective views of an example of an external appearance configuration of an ink jet printer serving as a recording apparatus according to an embodiment of the invention, viewed from the front side. FIG. 3 is a perspective view of the printer viewed from the rear side. FIG. 4 is a perspective view showing the internal structure of the printer. This ink jet printer 100 is a large size printer capable of carrying out recording on a cut sheet of comparatively large size such as size A0 of the JIS standard and size B0 of the JIS standard or alternatively on a roll sheet R having such a sheet width. As shown in FIGS. 1 to 4, the ink jet printer 100 comprises: a printer body section 110 having the shape of a rectangular parallelepiped; and a printer stand section 120 for supporting the printer body section 110.

As shown in FIGS. 1 to 4, the printer body section 110 is divided into two layers stacked up and down. As shown in FIG. 3, a roll sheet accommodating section 130 is arranged in a boundary part between the upper and lower layers on the rear side. Then, as shown in FIGS. 1 to 4, a paper feed and ejection section 140 and a recording section 150 are arranged in the upper layer. Further, as shown in FIGS. 1 to 4, a sheet suction section 160 is arranged in the center of the lower layer. Furthermore, an ink supply section 170 is arranged on the left-hand side of the lower layer viewed from the front side, while a head characteristics recovery section 180 and a drive controlling section 190 are arranged up and down on the right-hand side of the lower layer viewed from the front side. Further, as shown in FIGS. 1 to 4, a waste ink collecting section 200 is arranged in a vicinity of the printer stand section 120 under the drive controlling section 190.

As shown in FIGS. 1 to 3, the printer body section 110 comprises: an upper housing 111 composed of plastic or a sheet metal for covering the paper feed and ejection section 140 and the recording section 150; and a lower housing 112 composed of plastic or a sheet metal for covering the sheet suction section 160, the ink supply section 170, the head characteristics recovery section 180, and the drive controlling section 190. As shown in FIG. 2, in the upper housing 111, a body cover 113 composed of plastic or a sheet metal is arranged such that a part extending from the center front surface to the center upper surface can be opened. Further, as shown in FIG. 2, in the lower housing 112, an ink cover 114 composed of plastic or a sheet metal is arranged such that the front face of the ink supply section 170 can be opened.

As shown in FIGS. 1 and 2, the rear part of the body cover 113 is rotatably supported by the upper housing 111. When a user inserts fingers into finger catching sections 113*a* composed of recesses formed in the front face and then pushes up or down the cover, the cover opens or closes. The user can open the body cover 113 and thereby obtain a large space above the paper feed and ejection section 140 and the recording section 150. This permits easy maintenance work for the recording head 152, the carriage 153, and the like and easy work of releasing or the like of a sheet conveyance error such as paper jam that occurs during recording or conveyance. Further, as shown in FIGS. 1 and 3, in the body cover 113, a window 113*b* composed of transparent or translucent plastic is provided in a part of the upper surface. Thus, even without opening the body cover 113, the user can visually recognize the state of recording and the state of conveyance by looking inside through the window 113*b*.

As shown in FIGS. 1 and 2, the two side parts of the ink cover 114 are slidably supported by the lower housing 112. When a user inserts fingers into a finger catching section 114*a* composed of a recess formed in the front face and then pushes up or down the cover, the cover opens or closes. The user can open the ink cover 114 and thereby obtain a large space in front of the ink supply section 170. This permits easy work of charging or the like of the ink cartridge 10. Further, as shown in FIGS. 1 and 2, in the ink cover 114, a window 114*b* composed of transparent or translucent plastic is provided in a part of the front surface. Thus, even without opening the ink cover 114, the user can visually recognize the state of the ink cartridge 10 by looking inside through the window 114*b*.

Further, as shown in FIGS. 1 to 3, in the printer body section 110, an operation panel 115 for a user to operate recording control and the like is arranged on the right-hand side of the upper surface of the upper layer viewed from the front side. The operation panel 115 is provided with a liquid crystal display and various buttons, so that the user can perform button operation while watching and checking the liquid crystal display. This allows the user to perform reliable operation by means of visual recognition, and thereby avoids an operation error, an operation mistake, and the like.

As shown in FIGS. 1 to 4, the printer stand section 120 comprises: two supporting posts 121 each having an inverted T shape; and a reinforcement support 122 extending between these supporting posts 121. Then, the printer body section 110 is placed on the supporting posts 121, and then fixed with screws. As such, since the printer stand section 120 lifts up the printer body section 110, the user can easily perform paper feed and ejection processing, various maintenance processing, and the like. Further, an ejected paper receiving section can be arranged in the space in the printer stand section 120. This permits efficient collection of recorded sheets, and prevents contamination and the like in the recorded sheets.

As shown in FIG. 3, the roll sheet accommodating section 130 comprises: a spindle 131 installed through the inner periphery of a roll sheet R and thereby supporting the roll sheet R; and unshown bearings for pivotally retaining both ends of the spindle 131 in a freely rotatable manner. The rear face of the sheet suction section 160 is formed in a manner depressed relative to the rear face of the ink supply section 170 and the rear face of the head characteristics recovery section 180 and the drive controlling section 190 arranged on both sides. Then, the roll sheet accommodating section 130 is arranged using this depression.

That is, each opposing side face of the ink supply section 170 or the head characteristics recovery section 180 and the drive controlling section 190 is provided in the inside with an unshown bearing for pivotally retaining each end of the spindle 131 arranged in the main scanning direction, in a freely rotatable manner. Then, when the spindle 131 installed through the inner periphery of the roll sheet R is placed between these bearings, the roll sheet R can be set up without protruding from the rear side of the printer body section 110.

As shown in FIG. 4, the paper feed and ejection section 140 comprises a paper feed roller 141 and a corresponding paper feed follower roller 142. The paper feed roller 141 and the paper feed follower roller 142 are arranged immediately downstream the feed direction of the roll sheet accommodating section 130, that is, on the rear side within the printer body section 110, in such a manner that their axes are oriented in the main scanning direction and their periphery surfaces oppose up and down. The paper feed roller 141 is formed in the form of a long roller. A part of its periphery surface slightly wider than the maximum recordable sheet width is coated with ceramic powder or the like. This avoids sliding in the paper feed, and hence achieves precise paper feeding. Both ends of the paper feed roller 141 are pivotally retained by a side frame 116 via bearings not shown. The paper feed roller 141 is driven in the normal or reverse revolution direction by a driving force transmitted from a paper feed motor 143 via a belt pulley 144 and a belt 145.

The paper feed follower roller 142 is formed in the form of a plurality of short rollers, and is pivotally retained in a freely rotatable manner by a plurality of follower roller support members 146 arranged in the axis direction above the paper feed roller 141. The paper feed follower roller 142 is pressed against the paper feed roller 141 by unshown biasing members such as springs attached in the follower roller support members 146, and thereby revolves in the normal or reverse direction in association with the normal or reverse revolution driving of the paper feed roller 141. Thus, the sheet can be fed out in a manner pressed firmly from both sides. This permits precise recording. Then, the paper feed roller 141 and the paper feed follower roller 142 pinch the roll sheet R or the cut sheet fed from the paper feed port 147 formed between the upper and lower layers of the printer body section 110 shown in FIG. 3, then feed out the sheet onto a platen 151 of the recording section 150 shown in FIGS. 2 and 4, and then eject the sheet through a paper ejection port 148 formed between the upper and lower layers of the printer body section 110 shown in FIG. 1.

As shown in FIGS. 2 and 4, the recording section 150 comprises: a platen 151 arranged immediately downstream the conveyance direction of the paper feed roller 141; a carriage 153 which is a feature of the invention and which carries a recording head 152; and a cutter 154 mounted on the carriage 153. The recording section 150 further comprises: an unshown flexible flat cable (FFC, hereafter) for electrically connecting the recording head 152 to the drive controlling section 190 for carrying out recording; an unshown ink tube for connecting the recording head 151 to the ink cartridge 10 containing ink.

The platen 151 is formed in a rectangular plate shape having a length slightly greater than the maximum recordable sheet width, and is arranged along the paper feed roller 141. In the platen 151, a plurality of unshown holes leading to the sheet suction section 160 are punched from the front surface to the rear surface. Further, the front surface is provided with a plurality of unshown recesses and protrusions for absorbing the cockling or the like of the sheet caused by moisture absorption. Thus, the sheet under the recording can be maintained almost flat. This permits precise recording.

Further, the surface of the platen 151 is provided with a cutter groove 151*a* extending in the main scanning direction. The cutter groove 151*a* is formed in a size capable of accommodating the blade tip of the cutter 154 protruded from the undersurface side of the roll sheet R in order that the surface of the platen 151 will not be damaged when the cutter 154 cuts the roll sheet R in the width direction. Thus, the recorded portion and the unrecorded portion of the roll sheet R can be separated reliably.

The recording head 152 is arranged in a manner opposing, with predetermined spacing, the cut sheet or the roll sheet R fed on the upper surface of the platen 151 under the carriage 153. The recording head 152 comprises: a black ink recording head for discharging two kinds of black ink; and a plurality of color ink recording heads for discharging ink of each color such as cyan, magenta, yellow, light cyan, light magenta, and gray. The recording head 152 is provided with pressure generating chambers and nozzle orifices connected thereto. When ink is stored in a pressure generating chamber and then pressurized to a predetermined pressure, an ink drop of a controlled size is discharged from the nozzle orifice onto the cut sheet or the roll sheet R fed on the upper surface of the platen 151.

The carriage 153 is placed, via unshown bearings, on a carriage guide shaft 155 provided in the main scanning direction, and is coupled to a belt 156. Then, when a carriage drive motor 305 that constitutes traveling means described later revolves a motor pulley 157 constituting the traveling means so that a belt 156 constituting the traveling means rotates, the carriage 153 can perform reciprocating motion in the main scanning direction in association with the motion of the belt 156 in a manner guided by the carriage guide shaft 155. This achieves precise motion of the carriage 153, and hence permits precise recording.

The cutter 154 is arranged in the orientation that the blade tip directs downward and in a manner capable of going up and down and moving in the main scanning direction. The cutter 154 goes up and down by means of a solenoid or the like, and moves in the main scanning direction together with the carriage 153. Thus, no other separate means for moving the cutter 154 is necessary. This achieves space reduction and cost reduction. In an alternative configuration, the cutter 154 may be separated from the carriage 153, and moved in the main scanning direction by means of a dedicated belt mechanism, a dedicated motor, or the like.

One end of the FFC is connected to a connector of the drive controlling section 190, while the other end is connected to a connector of the recording head 152, so that a recording signal is transmitted from the drive controlling section 190 to the recording head 152. The ink tubes are arranged corresponding to the respective colors described above. One end of each tube is connected to the ink cartridge 10 of each corresponding color via ink pressurizing and supplying means not shown. The other end of each tube is connected to the recording head 152 of each color. Then, each ink tube transports the ink of each color pressurized by the ink pressurizing and supplying means, from the ink cartridge 10 to the recording head 152.

As shown in FIG. 4, the sheet suction section 160 comprises: a pressure chamber 161 arranged under the platen 151; and an unshown fan arranged under the pressure chamber 161. The pressure chamber 161 is formed in a box shape in which a part of the top and bottom faces are opened. The platen 151 is attached in the open part of the top face, while the fan is attached in the open part of the bottom face. When the fan is revolved, air is allowed into the pressure chamber 161 through the holes punched in the platen 151, and then exhausted through the fan to the outside. Thus, when the cut sheet or the roll sheet R is fed onto the upper surface of the platen 151, a negative pressure is generated on the undersurface side of the cut sheet or the roll sheet R, so that the cut sheet or the roll sheet R is attracted to the upper surface of the platen 151. This avoids lifting of the cut sheet or the roll sheet R, and hence maintains a high recording accuracy.

As shown in FIG. 4, the ink supply section 170 comprises: a box shaped cartridge accommodating section 171; and cartridge pressing sections 172 attached on the front side of the cartridge accommodating section 171. The cartridge accommodating section 171 is partitioned such that ink cartridges 10 for a total of eight colors consisting of two kinds of black as well as cyan, magenta, yellow, light cyan, light magenta, and gray arranged in this order starting at the left-hand side of the figure can individually be pulled out or pushed in from the front side direction. Each cartridge pressing section 172 is attached in a manner capable of being freely opened and closed for each partition of the cartridge accommodating section 171. Then, in linkage with closing operation, the ink cartridge 10 in each partition is pressed in, while in linkage with opening operation, the ink cartridge 10 in each partition is pushed out.

Here, in the ink cartridge 10, an exterior case formed in the shape of a rectangular parallelepiped with a hard plastic material or the like contains and seals an ink tank which is formed in a bag shape with a flexible material or the like and which is filled with the ink. Further, the surface on the side inserted into the cartridge accommodating section 171 is provided with: an ink supply opening connected to the ink tank; and a positioning hole used in the cartridge accommodating section 171. On the other hand, in the inner rear face of the cartridge accommodating section 171, an ink supply needle for being inserted into the ink supply opening of the ink cartridge 10 and a positioning needle for being inserted into the positioning hole of the ink cartridge 10 are arranged in a manner protruding to the direction of pulling out and pushing in the ink cartridge 10.

Thus, when the cartridge pressing section 172 is closed, in the ink cartridge 10 accommodated in the cartridge accommodating section 171, the positioning needle automatically enters through the positioning hole so that positioning is achieved. At the same time, the ink supply needle automatically enters through the ink supply opening so that ink supply to the recording head 152 becomes ready. On the other hand, when the cartridge pressing section 172 is opened, the positioning needle is automatically extracted from the positioning hole, while the ink supply needle is automatically extracted from the ink supply opening.

The head characteristics recovery section 180 is arranged under the carriage 153 located in the home position shown in FIG. 4, and comprises wiping means, capping means, and suctioning means, as well as driving means for these. The wiping means comprises a wiper formed approximately in a rectangular plate shape with rubber, felt, plastic, or the like. Then, when the nozzle formation surface of the recording head 152 is rubbed, ink adhering to the nozzle formation surface is wiped off.

The capping means comprises a cap formed with rubber approximately in the shape of a rectangular parallelepiped. A recess provided in the upper part is pressed against the nozzle formation surface of the recording head 152, and thereby seals the nozzle orifices. The suctioning means forcedly suctions and discharges the ink in order to remove clogs in the nozzle orifices or air bubbles having mixed in. Thus, in the state that the carriage 153 is located in the home position, processing can be performed for maintaining at constant the ink discharge characteristics of the recording head 152.

The waste ink collecting section 200 comprises a waste liquid cartridge 201 capable of being detached and attached freely. The waste liquid cartridge 201 stores waste liquid such as ink used in the initial charging of the ink supply system that leads to the recording head 152 and cleaning liquid used in the cleaning of the ink supply system that leads to the recording head 152. Thus, disposal of the waste liquid can be completed merely by changing the waste liquid cartridge 201. This reduces the number of work steps, and further avoids contamination in the printer periphery.

Figure 5:
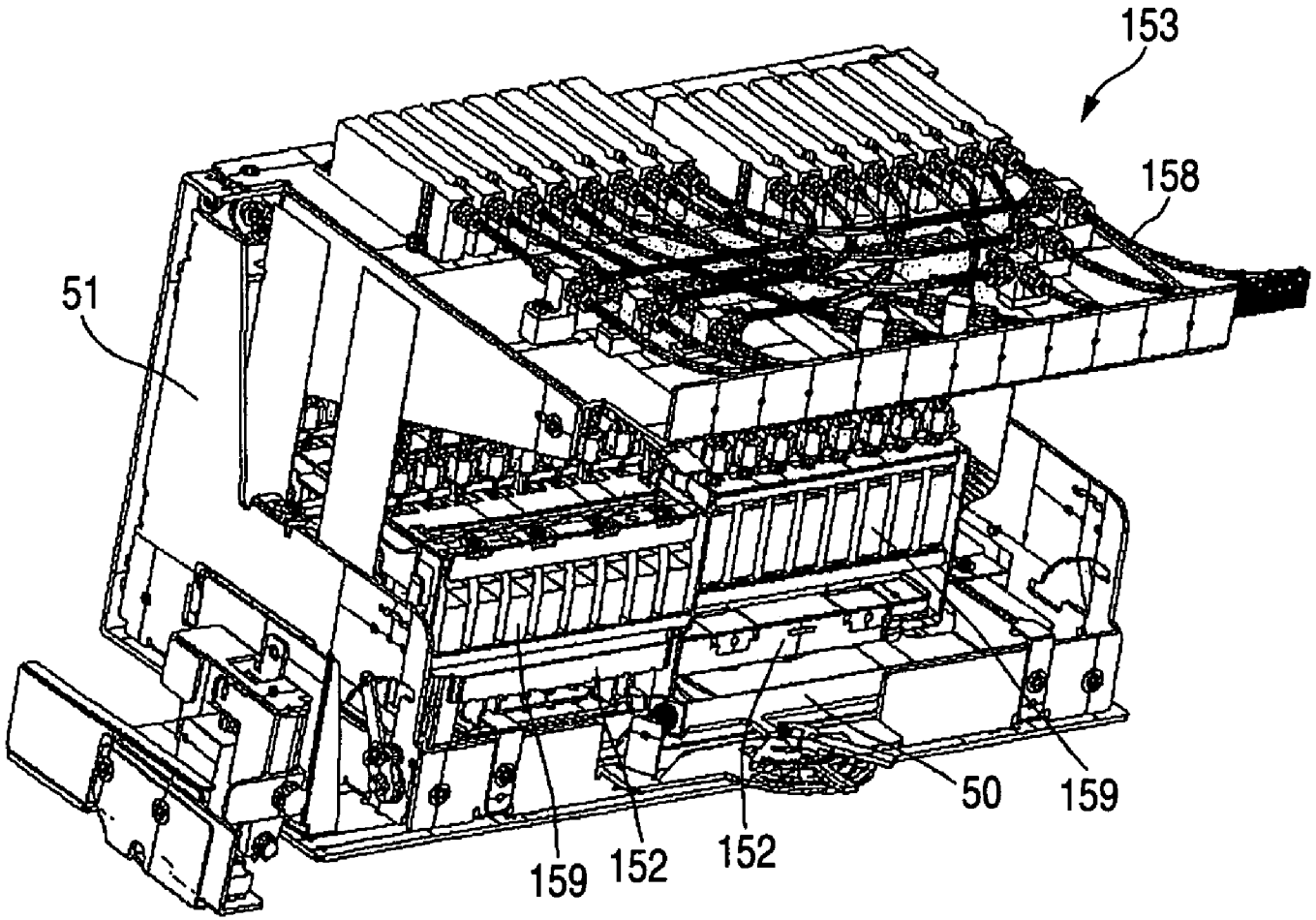
FIG. 5 is a perspective view showing the details of a carriage of the printer of FIG. 1.

FIG. 5 is a perspective view showing the details of the carriage 153. The carriage 153 comprises: a sub-carriage 50 provided with the recording heads 152 and the like; and a carriage body 51 provided with dampers 159 and the like. The recording heads 152 are arranged in two rows in each of the main scanning direction and the vertical scanning direction. The dampers 159 are arranged in two in each of the upper and lower stages of the carriage body 51. Then, the four dampers 159 are connected respectively to the ink tubes 158 in a total of eight colors, and thereby store temporarily the ink transported from the ink tubes 158. The four recording heads 152 are connected respectively to the four dampers 159, and thereby discharge the ink transported from the dampers 159.

The configuration of the ink jet printer serving as a recording apparatus according to an embodiment of the invention has been described above. Next, a controlling method for the carriage drive motor according to an embodiment of the invention is described below.

Figure 6:
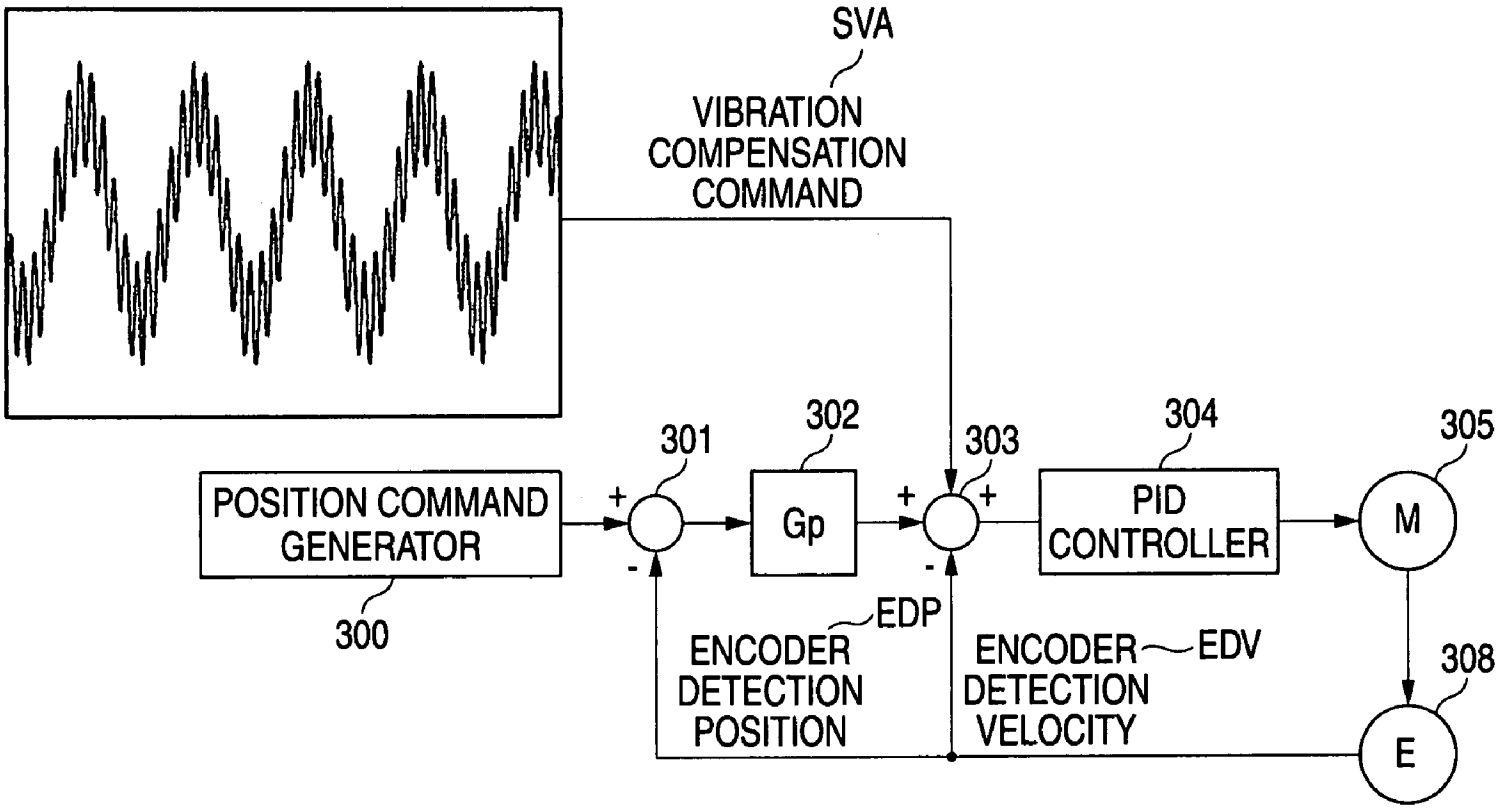
FIG. 6 is a control block diagram of a carriage drive motor, illustrating a feature of the invention.

FIG. 6 is a control block diagram showing the carriage drive motor which is a feature of the invention. The control block of the carriage drive motor shown in FIG. 6 comprises a position command generator 300, a subtractor 301, a target velocity arithmetic operation section 302, a subtractor 303, a PID control section 304, a carriage drive motor 305, and an encoder 308. The encoder 308 detects an encoder detection position EDP and an encoder detection velocity EDV serving as controlled variables of the feedback control, and then outputs the encoder detection position EDP to the subtractor 301 and the encoder detection velocity EDV is outputted to the subtractor 303. Here, the structure of the encoder 308 and the technique that the encoder detection position EDP and the encoder detection velocity EDV are outputted as controlled variables of feedback control are already known art. Thus, detailed description is omitted.

The position command generator 300 outputs a target position to be inputted to the control block in order that the carriage drive motor 305 should be driven in a predetermined operation. In the control block shown in FIG. 6, the actual operation of the carriage drive motor 305 is fed back, so that control is performed such that the target position should be followed.

The subtractor 301 calculates and outputs a position error between the target position outputted from the position command generator 300 and the encoder detection position element EDP indicating the actual position of the carriage 153. The target velocity arithmetic operation section 302 calculates a target velocity of the carriage 153 on the basis of the position error outputted from the subtractor 301. This arithmetic operation is performed by multiplying the position error by a position gain Gp. The position gain Gp is determined depending on the position error. The target velocity is outputted after the arithmetic operation.

The subtractor 303 calculates a velocity error on the basis of the target velocity outputted from the target velocity arithmetic operation section 302, the encoder detection velocity EDV indicating the actual velocity of the carriage 153, and a vibration compensation command SVA which is a later-described feature of the invention. The velocity error is outputted after the arithmetic operation.

The PID controller 304 comprises a proportional element, an integral element, and a differentiating element which are not shown. Each element performs the arithmetic operation of each element on the velocity error outputted from the subtractor 303. These results are added together by an adder not shown. After that, the output from the PID controller 304 is transmitted to an unshown D/A converter, thereby converted into analog current, and then provided to the carriage drive motor 305.

Figure 7:
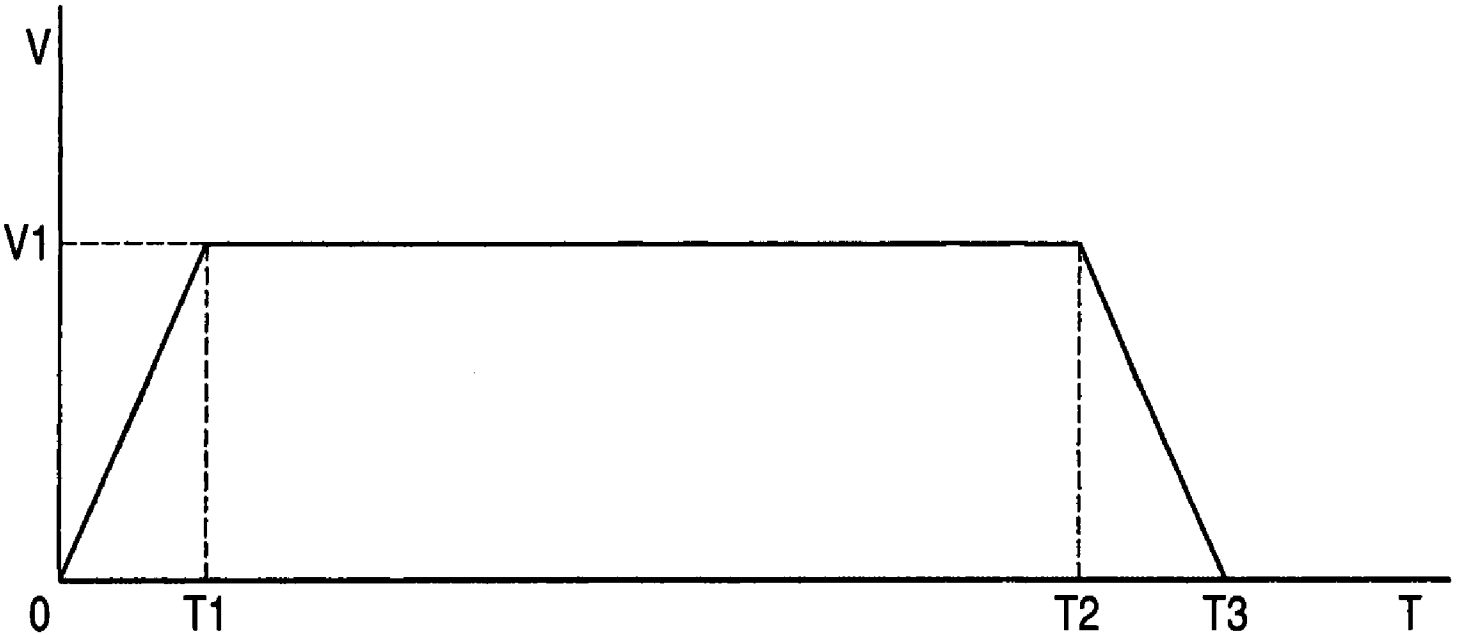
FIG. 7 is a diagram showing a velocity change in a carriage drive motor shown in FIG. 6.

FIG. 7 is a diagram showing the velocity change of the carriage drive motor. FIG. 7 shows the velocity change of the carriage drive motor 305 at the time that the carriage 153 is driven in either a going trip or a return trip of the reciprocating drive. The vertical axis indicates the velocity V, while the horizontal axis indicates the time T. In the velocity control of the carriage drive motor 305 described above, as shown in the velocity change of FIG. 7, the motor is accelerated to a predetermined velocity V1 (between time points 0-T1). Then, after reaching the predetermined velocity V1, the motor is switched to constant velocity control. After that, the carriage drive motor 305 is driven at a constant velocity for a predetermined time (the time of constant velocity) (between T1–T2). After that, the motor is slowed down at a predetermined rate, and then stopped (between T2–T3). The PID control is used in the constant velocity control and the slowdown control in the course of acceleration.

Figure 8:
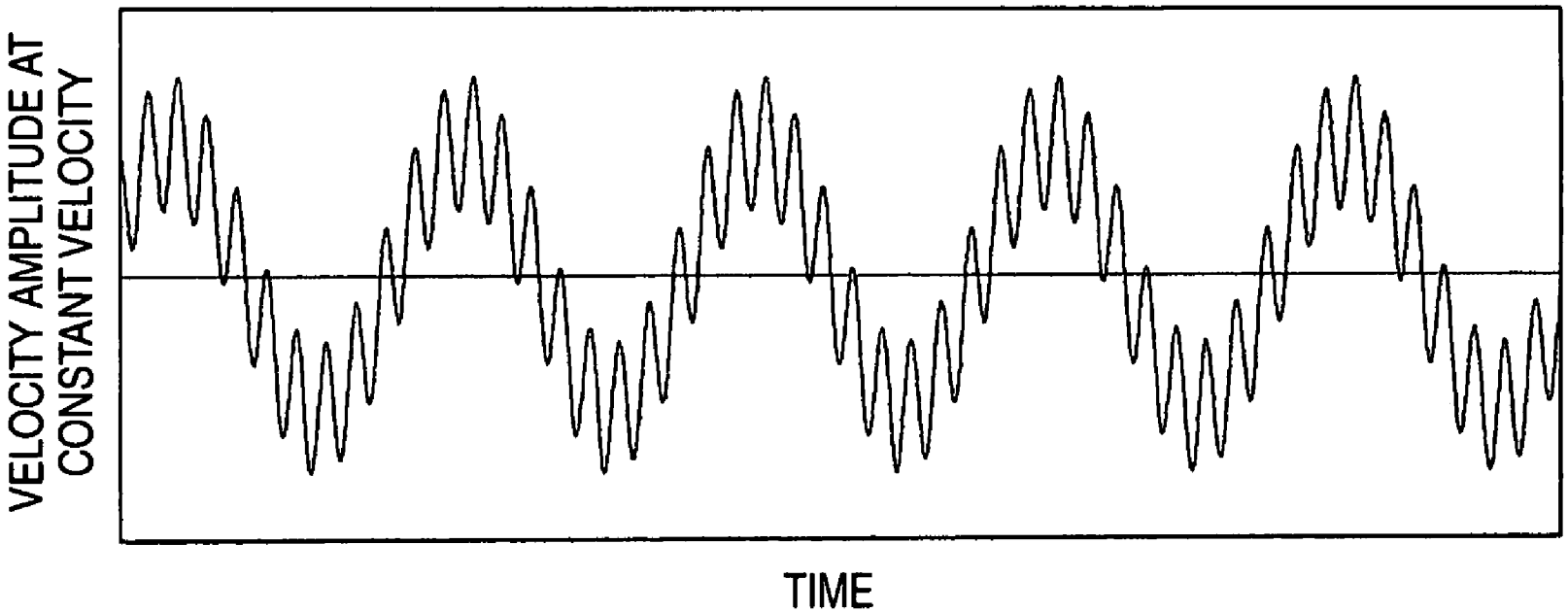
FIG. 8 is a diagram showing a periodic oscillation of the motor velocity used as the basis of a vibration compensation command shown in FIG. 6.

FIG. 8 is a diagram showing the periodic oscillation of the motor velocity used as the basis of a vibration compensation command which is a feature of the invention. In FIG. 8, the vertical axis indicates the velocity amplitude at the time of constant velocity, while the horizontal axis indicates the time. In the velocity change of the carriage drive motor shown in FIG. 7, a periodic velocity fluctuation is actually generated as shown in FIG. 8 during the period that the carriage drive motor 305 is driven by constant velocity control, that is, during the time of constant velocity between T1–T2. This periodic velocity fluctuation is remarkably smaller than the velocity change of the carriage drive motor 305 shown in FIG. 7, and hence is not clearly apparent in FIG. 7. The horizontal line in the center of FIG. 8 indicates the predetermined velocity V1. In the embodiment of the invention, this velocity V1 is used as the target velocity, so that control is performed by the control block of FIG. 6 in such a manner that the actual velocity of the carriage drive motor 305 should follow the target velocity.

Here, the periodic velocity change is generated by cogging, eccentricity of the motor pulley 157, and the like. The cogging indicates a vibration of a comparatively short period generated in the shaft of the carriage drive motor 305 caused by gaps referred to as slots between each magnetic pole and another magnetic pole of the carriage drive motor 305. The vibration caused by cogging is unavoidably generated owing to the structure of the carriage drive motor 305. Further, the machining accuracy of the motor pulley 157 and the like causes eccentricity in the revolution of the motor pulley 157. Then, this eccentricity generates a vibration in the carriage 153. The vibration caused by the motor pulley 157 and the like is also unavoidably generated owing to the structure of the motor pulley 157 and the like. Thus, the periodic velocity change caused by cogging or the motor pulley 157 and the like is unavoidable owing to the structure. The periodic velocity change has resulted in a vibration in the recording head 152 of the carriage 153, and hence caused a vibration in the carriage and nonuniformity in the recording pitch of the main scanning direction. Further, since the amplitude of the velocity change is extremely small, the vibration has been difficult to be reduced by a prior art feedback control method in which the present velocity is detected so that the error from a command value is used as a torque command. Thus, according to the invention, as shown in FIG. 6, a vibration compensation command SVA described later is generated and then added to the control logic by a feedforward control method. In FIG. 8, a velocity change appears that is generated by combining the vibration of a comparatively short period generated by cogging and the vibration of a comparatively long period generated by eccentricity of the motor pulley 157 and the like.

Figure 9:
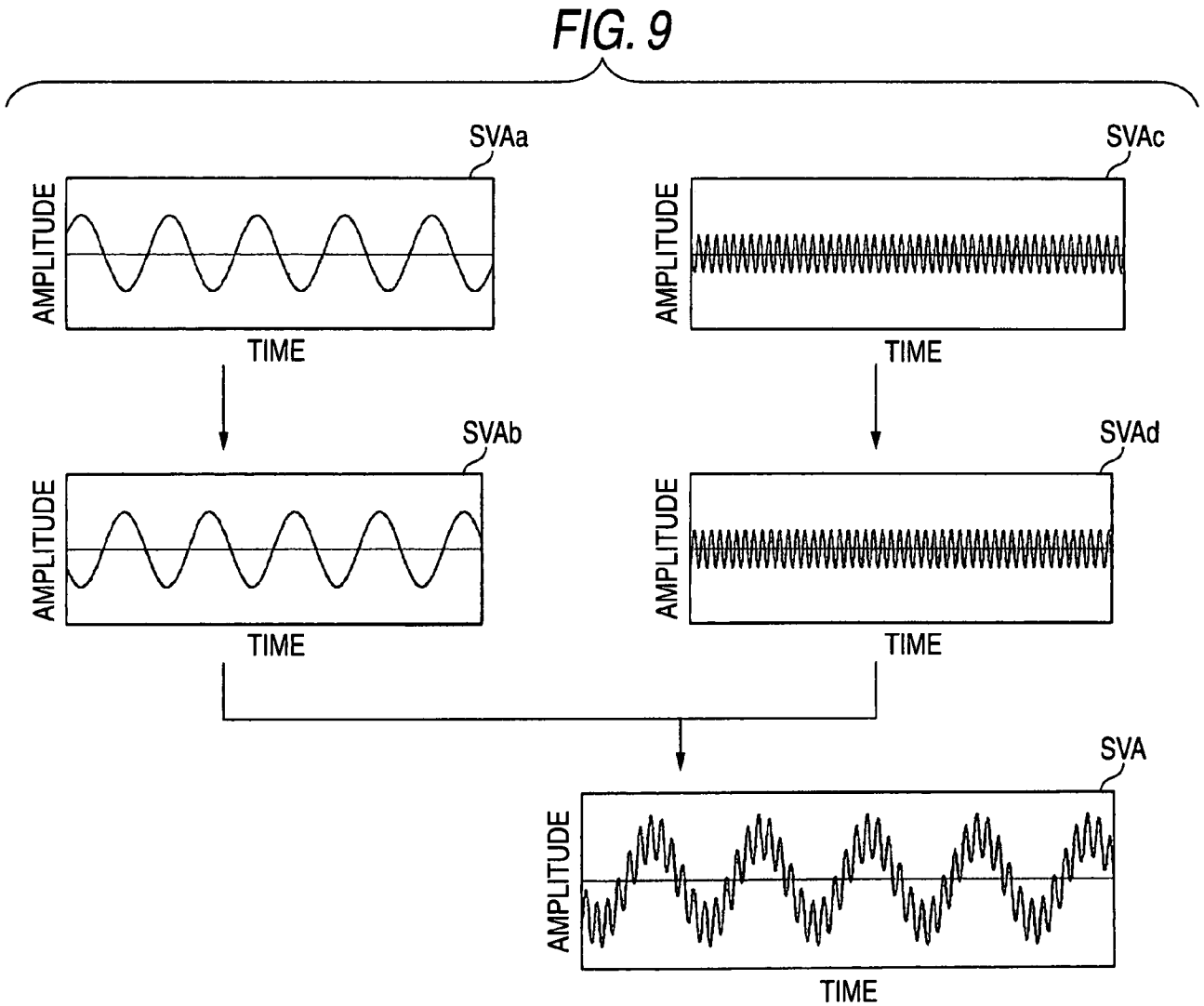
FIG. 9 is a diagram showing a process of generating a vibration compensation command shown in FIG. 6.

FIG. 9 is a diagram showing a process of generating a vibration compensation command SVA. In FIG. 9, the vertical axis indicates the amplitude, while the horizontal axis indicates the time. The vibration compensation command SVA is generated as follows. First, the actual velocity change of the carriage 153 is detected by the encoder 308. As shown in FIG. 8, this velocity change includes the periodic vibration caused by cogging or the motor pulley 157 and the like. The detected velocity change described above is fed back as the encoder detection velocity EDV to the subtractor 303 shown in FIG. 6. At the same time, arithmetic analysis is performed on the detected velocity change described above. In the embodiment of the invention, the Fourier transformation is employed as the arithmetic analysis although not shown. Here, since the Fourier transformation is a known art, detailed description is omitted.

In the embodiment of the invention, the detected velocity change described above is a composite waveform generated by combining a constant velocity component which is the target velocity, a vibration component having a comparatively short period caused by cogging, and a vibration component having a comparatively long period caused by the motor pulley 157 and the like. When the composite waveform is processed by the Fourier transformation, each waveform having each period is separated. In FIG. 9, a vibration component SVAa having a comparatively long period caused by the motor pulley 157 and the like and a vibration component SVAc having a comparatively short period caused by cogging are selected in order to be damped. The phase of the vibration component SVAa having a comparatively long period caused by the motor pulley 157 and the like which has been analyzed by the Fourier transformation is shifted by a predetermined value, so that a vibration compensation component SVAb for the motor pulley 157 and the like is generated. Similarly, the phase of the vibration component SVAc having a comparatively short period caused by cogging is also shifted by a predetermined value, so that a vibration compensation component SVAd for cogging is generated. Then, the vibration compensation components SVAb and SVAd are combined together, so that a vibration compensation command SVA is generated. In the embodiment of the invention, the predetermined value is 180°. Thus, the vibration compensation command SVA has the same period and amplitude as those of the velocity change detected by the encoder 308, and further has the opposite phase. When the vibration compensation command SVA is inputted to the subtractor 303 of the control logic shown in FIG. 6, the periodic vibrations can be damped that are caused by cogging or the motor pulley 157 and the like. Thus, a state can be realized that is approximately near the state of constant velocity in which the target value of the embodiment of the invention is achieved (between T1–T2 of FIG. 7). Thus, as shown in FIG. 8, the periodic velocity fluctuation can be damped during the period that driving is performed by constant velocity control of the target velocity, that is, between T1–T2. This avoids the nonuniformity in the recording pitch of the main scanning direction.

As described above, according to the drive controlling method for a carriage of the present embodiment, the period, the phase, and the amplitude of a vibration generated in the carriage 153 are detected, so that the velocity of the carriage 153 is controlled on the basis of a signal having the same period and amplitude as the period and amplitude as well as having a phase shifted by a predetermined value from the phase. This permits damping of the vibration caused by cogging, eccentricity of the motor pulley 157, or the like, which causes nonuniformity in the recording pitch of the main scanning direction, without providing a complicated vibration absorbing mechanism. Thus, the nonuniformity which could be caused in the recording pitch of the main scanning direction can be avoided.

Further, the period, amplitude, and phase are acquired by performing arithmetic analysis on the velocity of the carriage 153. This permits easy acquisition of the period, the amplitude, and the phase of the vibration caused by cogging, eccentricity of the motor pulley 157, or the like which causes nonuniformity in the recording pitch of the main scanning direction.

Further, a vibration affecting recording precision is selected from a plurality of vibrations and then damped. Thus, an unnecessary vibration which causes nonuniformity in the recording pitch of the main scanning direction can be selected from the vibrations caused by cogging, eccentricity of the motor pulley 157, and the like, and can then be damped.

Further, the predetermined value is a command value for providing an opposite phase signal to the power source. Thus, when the predetermined value is changed, this method is applicable to any control block having an arbitrary controlling delay value. Here, the opposite phase signal is a generic name of various signals each having a phase shifted by a predetermined value from the phase of the vibration caused by cogging, eccentricity of the motor pulley 157, or the like, and is not limited to a signal shifted by 180° from the phase of the vibration. That is, the shift may be at any value.

Further, the predetermined value may be 180°±90°. This permits setting up of an optimal predetermined value, and hence minimizes the vibration.

The scope of the invention is not limited to the embodiment described above. That is, the invention is applicable to other various embodiments as long as they do not contradict the description of the scope of the claims. For example, in the embodiment of the invention, the predetermined value is set to be 180°. However, the value is not limited to this specific one, and may be set up arbitrarily as long as the vibration can be damped. Further, the driving waveform outputted to the carriage drive motor 305 is preferably in the opposite phase (a shift of 180°) relative to the periodic vibration of the encoder detection velocity EDV caused by cogging or the motor pulley 157 and the like. Thus, in a control logic having a control delay element, while taking the control delay element into consideration, the shift between the encoder detection velocity EDV and the vibration compensation component SVAb or SVAd need not be 180°, and may be a phase delayed by the amount of the control delay element.

Further, in the embodiment of the invention, the detection of the periodic vibration caused by cogging or the motor pulley 157 and the like is performed by the encoder 308 at each time of driving of the carriage 153. However, cogging is determined depending on the design specification and the mounting position of the carriage drive motor 305. Further, the vibration caused by the motor pulley 157 and the like is similarly determined by machining accuracy of the motor pulley 157. Thus, these differ depending on the apparatus. Accordingly, the periodic vibration caused by cogging, eccentricity of the motor pulley 157, or the like need be detected in each apparatus. However, since no large change occurs after the fabrication, the detection of the vibration caused by the encoder 308 may be performed, for example, solely at the time of fabrication. Alternatively, the vibration may be detected during the reciprocating operation (initialing) of the carriage 153 performed when the power is turned on. This method avoids the necessity of the work of performing the Fourier transformation on the detected velocity change and then inputting the transformed waveform as the vibration compensation command SVA to the control logic.

Further, in the embodiment of the invention, the Fourier transformation is performed on the periodic vibration caused by cogging or the motor pulley 157 and the like, so that a vibration compensation command SVA having a shifted phase is generated so that the periodic vibration caused by cogging or the motor pulley 157 and the like is reduced. However, the invention is not limited in particular to the periodic vibration caused by cogging or the motor pulley 157 and the like, and is applicable also to other vibrations. For example, the invention may be applied to a vibration at a resonance frequency.

The foregoing invention may also take the form of a set of instructions in a form that can be read by a computer. The instructions may be stored on a data carrier and/or a computer-readable memory, such as any memory device that is configured to store machine-readable instructions. For example, but not by way of limitation, the computer-readable medium may be a hard disk drive, portable memory, or other equivalent thereof.

Further, in the embodiment of the invention, the invention is implemented in an ink jet printer serving as a recording apparatus. However, the invention is not limited in particular to this apparatus, and is applicable also to a scanner or the like provided with a carriage.

The invention is applicable to any electronic apparatus such as a facsimile machine, a copy machine, and a scanner as long as the apparatus is provided with a carriage. Further, the invention is not limited to the apparatuses, and is applicable also to a liquid ejecting apparatus for ejecting a liquid corresponding to a specific application in place of the ink, from a liquid jet head onto an ejection target medium, and thereby causing the liquid to adhere to the ejection target medium. Such apparatuses include: a color material ejection head used in the fabrication of a color filter of a liquid crystal display or the like; an electrode material (electrically conductive paste) ejection head used in the formation of an electrode of an organic EL display, a surface emitting display (FED), or the like; a bio organic substance ejection head used in the fabrication of a biochip; and a sample ejection head serving as a precision pipette.

What is claimed is:

1. A drive controlling method of a carriage for performing reciprocating motion along a guide member, comprising:

detecting a first period, a first phase, and a first amplitude of a vibration generated in the carriage; and controlling a velocity of the carriage on the basis of a signal having a second period and a second amplitude each of which is the same as the first period and the first amplitude, and having a second phase shifted by a predetermined value from the first phase.

2. The drive controlling method according to claim 1, further comprising performing arithmetic analysis on the velocity of the carriage to detect the first period, the first amplitude, and the first phase.

3. The drive controlling method according to claim 1, further comprising extracting a vibration affecting precision from the vibration generated in the carriage to damp the vibration affecting a precision.

4. The drive controlling method according to claim 1, wherein the predetermined value is a value for providing an opposite phase signal to a power source of the carriage.

5. The drive controlling method according to claim 1, wherein the predetermined value is 180°±90°.

6. An electronic apparatus for at least one of reading and writing information, comprising a carriage controlled by a controlling method according to claim 1.

7. A recording apparatus for recording information on a recording medium, comprising a carriage controlled by a controlling method according to claim 1.

8. A liquid ejecting apparatus for ejecting liquid toward a target medium, comprising a carriage controlled by a controlling method according to claim 1.

9. A computer-readable medium including a set of instructions of controlling a carriage for performing reciprocating motion along a guide member, the set of instructions comprising:

detecting a first period, a first phase, and a first amplitude of a vibration generated in the carriage; and controlling a velocity of the carriage on the basis of a signal having a second period and a second amplitude each of which is the same as the first period and the first amplitude, and having a second phase shifted by a predetermined value from the first phase.

10. The drive computer-readable medium according to claim 9, further comprising performing arithmetic analysis on the velocity of the carriage to detect the first period, the first amplitude, and the first phase.

11. The computer-readable medium according to claim 9, further comprising extracting a vibration affecting a precision from the vibration generated in the carriage to damp the vibration affecting a precision.

12. The computer-readable medium according to claim 9, wherein the predetermined value is a value for providing an opposite phase signal to a power source of the carriage.

13. The computer-readable medium according to claim 9, wherein the predetermined value is 180°±90°.

* * * * *